United States Patent [19]

Stockman et al.

[11] 3,957,213

[45] May 18, 1976

[54] GYRATORY CRUSHER WITH MATERIAL DISTRIBUTION MEANS

[76] Inventors: Helmut Stöckman, Birkenstr. 24, 5047 Wesseling; Klaus Schütte, Hans-Schulten-Str. 10, 5 Cologne 91; Heinz Hürtmanns, Spechlstr. 21, 5 Cologne 60, all of Germany

[22] Filed: Mar. 31, 1975

[21] Appl. No.: 565,727

Related U.S. Application Data

[63] Continuation of Ser. No. 395,845, Sept. 10, 1973, abandoned.

[30] Foreign Application Priority Data

Sept. 16, 1972 Germany ..... 2245580

[52] U.S. Cl. ..... 241/202; 241/207

[51] Int. Cl.[2] ..... B02C 2/04

[58] Field of Search ..... 241/202, 207–216

[56] References Cited

UNITED STATES PATENTS

| | | | |
|---|---|---|---|
| 2,070,270 | 2/1937 | Gruender | 241/202 |
| 2,656,120 | 10/1953 | Roubal | 241/202 |
| 2,684,208 | 7/1954 | Werner | 241/215 X |
| 2,718,358 | 9/1955 | Burls | 241/207 X |
| 3,446,444 | 5/1969 | Kern | 241/202 |
| 3,533,568 | 10/1970 | Archer et al. | 241/202 |

*Primary Examiner*—Granville Y. Custer, Jr.
*Assistant Examiner*—Howard N. Goldberg
*Attorney, Agent, or Firm*—Hill, Gross, Simpson, Van Santen, Steadman, Chiara & Simpson

[57] ABSTRACT

A gyratory crusher in which a material distributing disc is disposed within supply conduit means at the top of the crusher housing and secured to the upper end of the crusher cone. The distributing disc is provided on its upper surface with upwardly projecting material guiding means.

5 Claims, 6 Drawing Figures

GYRATORY CRUSHER WITH MATERIAL DISTRIBUTION MEANS

Figure 1:
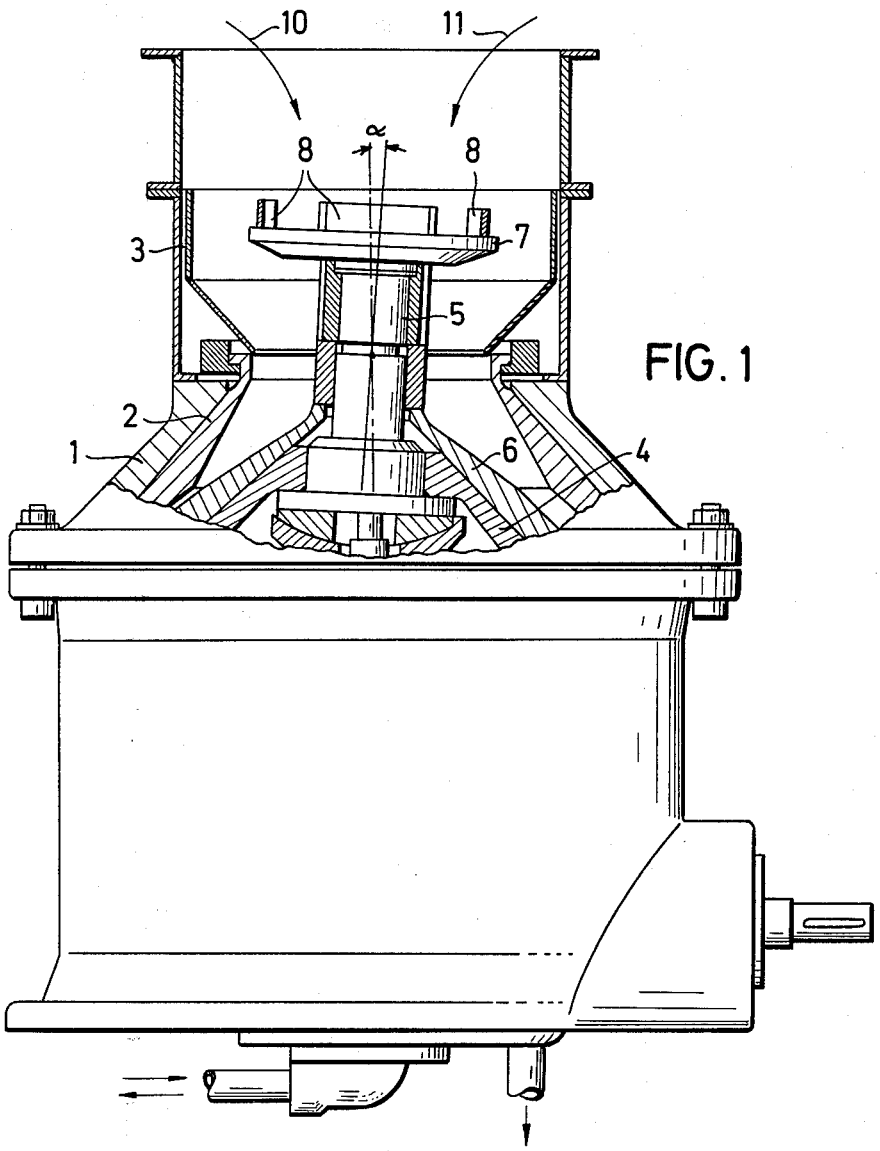

This is a continuation of application Ser. No. 395,845 filed Sept. 10, 1973 now abandoned.

This invention relates to a gyratory crusher which at the top of the crusher housing has an inlet opening in association with material conduit means, preferably in the form of a feed hopper, and with material distributing means disposed in said conduit means for distribution of the charge to the crusher gap between the crusher cone and a crusher lining on the inner surface of the housing.

In many cases gyratory crushers are charged not only with the basic material to be crushed, which is predominantly of large grain size, but also with material recovered from a subsequent sifting operation. Such re-supplied material is in comparison with the large grain size basic material of relatively small and uniform grain size, and it often represents the major portion of the supplied material. In such cases there is a tendency for the finer charge material to be discharged from the distributing means in such a way that it enters the annular crusher gap at a portion thereof only. This causes one-sided wear of the crusher linings which has a detrimental effect upon the grain shape and grain size obtained.

In order to avoid these disadvantages it has been suggested, for example in the U.S. Pat. No. 3,604,636, to use as a distributing means a separately driven distributing member rotatably mounted in the supply conduit above the crusher gap. Such a distributing means is, however, not only structurally very expensive but entails also a very significant increase in the costs of operation.

Accordingly, the object of the present invention is to provide in a gyratory crusher of the type indicated a charge distributing means which avoids the shortcomings of previously known means for the purpose in question, both with regard to efficiency and in respect of costs of manufacture, maintenance and operation.

Another object of the invention is to provide in a gyratory crusher of the kind indicated a charge distributing means which comprises a disc secured to the upper end of the pressure cone and provided on its top surface with one or more material guiding elements. In operation said disc automatically participates in the rotary and wobbling movement of the crusher cone, so that the material supplied to this disc from above, particularly the finer material, is brought along by the guiding element, or elements, in the rotary direction of the disc and uniformly distributed over the entire annular area of the crusher gap, and this is true even in cases where two portions of material of different grain size are supplied to the disc in separate streams. The gyratory crusher is in this manner protected against non-uniform load stresses and one-sided wear of the crusher elements.

A further object of the invention is to provide in a gyratory crusher of the kind indicated a disc-shaped charge distributing means which is secured to the upper end of the crusher cone in such a manner that the central axis of the disc coincides with the axis of the crusher cone and thus is inclined in relation to the vertical axis of the crusher housing.

In a preferred embodiment of the invention the charge guiding means on the top side of the disc means comprises an upwardly projecting annular element extending along the marginal region of the disc and interrupted at one or more places to form outlet openings for the charge material. Through this arrangement the material on the disc is subjected to a thorough mixing operation which favorably affects the uniformity of discharge from the disc.

In a preferred modification of the above described embodiment of the invention the annular upwardly projecting guiding element on the disc extends continuously around the disc, while the disc itself is provided with one or more outlet openings for the charge material. It is also feasible to combine the two lastmentiond embodiments, so that the annular projection is provided with gaps in the regions of said openings in the disc.

In order to keep the wear of the charge distributing means to a minimum said means may advantageously be provided, entirely or in part, with a coating of a highly wear-resistant material.

Figure 3:
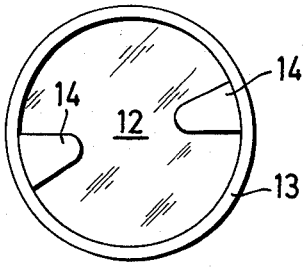
Figure 2:
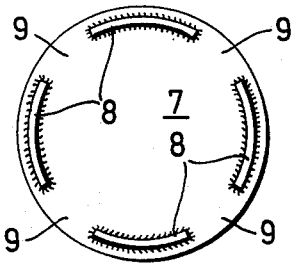
Figure 4:
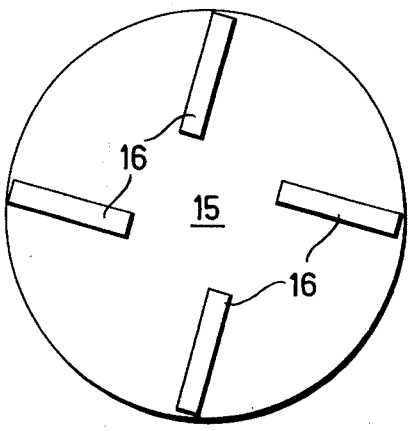
Figure 5:
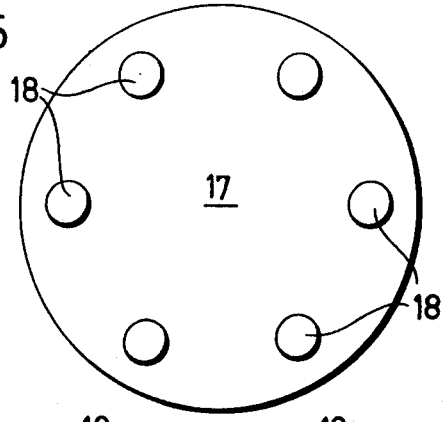
Figure 6:
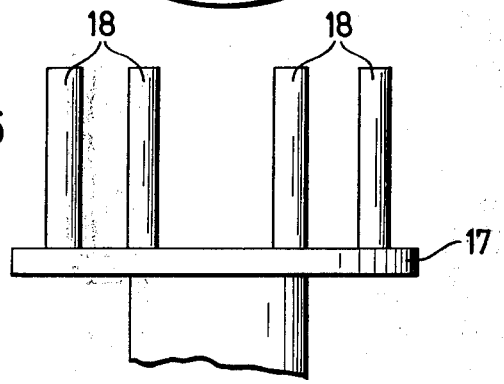

Further details, features and advantages of the invention are set forth in detail below with reference to the accompanying diagrammatical drawings, in which FIG. 1 is a partial section of a gyratory crusher provided with charge distributing means according to the invention, FIG. 2 is a top view of the distributing disc shown in FIG. 1, FIG. 3 shows another embodiment of a charge distributing disc according to the invention, with openings in the disc, and FIGS. 4, 5 and 6 show additional embodiments of charge distributing means according to the invention.

The gyratory crusher shown in FIG. 1 includes a crusher lining 2 secured to the inside of a housing 1. Extending upwardly from the crusher lining 2 there is a feed hopper 3.

The crusher cone 4, which has its axis inclined by an angle $\alpha$ (FIG. 1) in relation to the axis of the housing, extends from below with a head portion 5 into the feed hopper 3, said head portion 5 serving to clamp the crusher cone lining 6 in place. At the upper end of the crusher cone head portion 5 a circular disc 7 is secured which on its top surface is provided with an upwardly projecting material guiding element 8 which projects upwardly from the plane surface of the disc at least as high as the thickness of the disc and in which outlet openings 9 are arranged as shown in FIG. 2. In operation the basic charge material which predominantly comprises coarse pieces, is fed from above onto the distribution disc 7, for example as indicated by the arrow 10.

The pieces of the material which after passing through the crusher are still oversize although of comparatively fine and uniform grain size, are subsequently returned to the crusher as, for example, indicated by the arrow 11. As the circular disc 7 secured to the upper end of the crusher cone 4 rotates with said crusher cone 4 and therefore performs the same wobbling and at the same time rotary movement as the crusher cone about the inclined crusher cone axis, particularly the finer grain material is brought along by the disc 7 in its direction of rotation, whereby an intimate mixing of the fine and coarse grain materials occurs. The mixed material then leaves the circular disc 7 through the openings 9 and is thanks to the wobbling and rotary movement of the disc uniformly distributed over the entire extent of the crusher gap. In this manner the crusher tools of the crusher are very advantageously protected against irregular wear and a continuous mode of operation is obtained.

The openings 9 shown in FIG. 2 between the upwardly projecting material guiding elements 8 are according to the size and quantity of the material to be crushed of larger or smaller size. The diameter of the disc 7 may also in correspondence with the composition of the material to be crushed be made smaller or larger than the inner diameter of the crusher lining 2 in the region of its connection with the feed hopper 3.

Furthermore, as shown in FIG. 3 it may be advantageous to provide the disc 12 with an upwardly extending wall 13 along the edge of the disc and with openings 14 in the marginal portion of the disc itself. By means of these openings in the disc it is also possible to achieve in a very simple manner a uniform distribution of the material in the crusher gap of the gyratory crusher. In this case it is of advantage to properly adapt the size of the openings 14 in the disc to the coarse pieces in the charge material in order to prevent clogging of the openings in operation. In order to avoid such clogging of the openings 14 the wall 13 may also be omitted in the region of the opening.

As shown in FIG. 4, uniform feeding of material to the crusher gap may also in a suitable embodiment of the invention be achieved by providing on the disc 15 a number of vane elements 16 which extend inwardly from the marginal region of the disc, preferably at an angle to the radial direction.

In a further advantageous embodiment of the invention a thorough mixing and all-around uniform distribution of the material in the crusher gap may be obtained by arranging in the marginal region of the disc 17 a plurality of upwardly extending rods 18, as shown in FIGS. 5 and 6.

The invention is not limited to the embodiments described above and shown in the drawings. Without exceeding the scope of the subject matter of the invention the upwardly projecting elements on the disc may also be arranged radially and extend from the edge of the disc to the middle. The height of the projections may also be selected according to requirements. Furthermore, in the use of rods as material distributing elements it may be of advantage to arrange said rods in the form of a pyramid with the rods inclined towards each other.

Since in the operation of the gyratory crusher the guide elements provided on the disc are subject to intense wear, it is preferable to use guide elements made of a highly wear-resistant material or to provide said guide elements with a preferably exchangeable wear-protection covering. In the case of charge material that is highly abrasive it may be preferable to use a highly wear-resistant material also for the discs themselves.

We claim as our invention:

1. A gyratory crusher, comprising:

a housing having a top supply conduit for material to be crushed and at a lower level an interior crusher lining in position for crushing coaction with a crusher cone which is mounted for rotary and wobbling motion within said housing and has secured to its top surface a material distributing disc of substantial thickness located within said top supply conduit and having a plane top surface with upwardly projecting material guiding means comprising individual upstanding elements of a height at least as great as the thickness of the disc;

2. A gyratory crusher according to claim 1, in which the central axis of said distributing disc coincides with the axis of rotation of said crusher cone.

3. A gyratory crusher according to claim 1, in which said material guiding means comprises a substantially annular series of elements disposed adjacent to the edge of said disc and provided with said openings.

4. A gyratory crusher according to claim 1, in which said material guiding means comprises a plurality of vane elements extending inwardly from the edge of said disc.

5. A gyratory crusher according to claim 1, in which said material guiding means elements comprise a plurality of upwardly extending rods circumferentially distributed on said disc.

* * * * *